US007699649B2

(12) United States Patent
Busse

(10) Patent No.: US 7,699,649 B2
(45) Date of Patent: Apr. 20, 2010

(54) ELECTRICAL CONNECTING MODULE

(75) Inventor: Ralf-Dieter Busse, Waldesruh (DE)

(73) Assignee: ADC GmbH, Berlin (DE)

( * ) Notice: Subject to any disclaimer, the term of this patent is extended or adjusted under 35 U.S.C. 154(b) by 189 days.

(21) Appl. No.: 11/661,642

(22) PCT Filed: Aug. 24, 2005

(86) PCT No.: PCT/EP2005/009123

§ 371 (c)(1),
(2), (4) Date: Sep. 21, 2007

(87) PCT Pub. No.: WO2006/024438

PCT Pub. Date: Mar. 9, 2006

(65) Prior Publication Data

US 2008/0166916 A1 Jul. 10, 2008

(30) Foreign Application Priority Data

Sep. 2, 2004 (DE) ..... 10 2004 042 586

(51) Int. Cl.
*H01R 13/73* (2006.01)

(52) U.S. Cl. ..... 439/550; 439/552; 439/248

(58) Field of Classification Search ..... 439/550, 439/552, 553, 247, 284
See application file for complete search history.

(56) References Cited

U.S. PATENT DOCUMENTS 2,461,487 A * 2/1949 Wagstaff ..... 439/550
2,869,094 A * 1/1959 Francis ..... 439/550
3,651,446 A * 3/1972 Sadogierski et al. ..... 439/357
4,447,106 A 5/1984 Houtz et al.
5,066,247 A * 11/1991 Watson ..... 439/565

FOREIGN PATENT DOCUMENTS

| | | |
|---|---|---|
| DE | 102 57 308 B3 | 7/2004 |
| EP | 0 246 741 | 11/1987 |
| EP | 1 388 915 A1 | 2/2004 |
| FR | 1.549.834 | 12/1968 |
| GB | 941628 | 11/1963 |

* cited by examiner

*Primary Examiner*—Hien Vu
(74) *Attorney, Agent, or Firm*—Merchant & Gould P.C.

(57) ABSTRACT

The invention relates to an electrical connecting module comprising at least one connector strip for electrically connecting wires and/or cables. The connector strip has at least one catch element and a rigid front panel. This front panel has at least one opening through which the connector strip can be partially inserted and which is cut open in the area of the catch element. The connector strip rests against the face of the front panel via a stopping edge. A securing element can be locked from the rear side of the front panel by the connector strip. This securing element is situated between the catch element and the front panel, and the closed contour of the securing element forms a stopping face on the rear side of the front panel. The securing element has an at least partially elastic design whereby being elastic in the area of the catch element. The invention also relates to a securing element suitable for the electrical connecting module.

14 Claims, 2 Drawing Sheets

2
Q
L
D
1
O
5
3
Y
L
Q
X
4
6

L
18
16
3
Q
12
17
14

12
1
19
16
15
18
17
15
1
12

ELECTRICAL CONNECTING MODULE

The invention relates to an electrical connection module as well as a securing element suitable therefore.

Terminal strips for electrically connecting wires and cables are known which surround, for example, a plastic housing on which latching elements are arranged. Such a terminal strip is known, for example, from DE 102 57 308 B3. If it is intended for such terminal strips to be fixed to a rigid front panel, which is made of metal, for example, the problem arises that the latching tabs alone are not suitable. Since the front panel is rigid, the latching elements would shear off when latched on. On the other hand, if cut-free sections are provided for the latching elements on the front panel next to the opening for the terminal strip, the terminal strip must be fixed in some way to the front panel.

The invention is therefore based on the technical problem of providing a generic connection module which makes it possible in a simple and reliable manner to fix a terminal strip to a front panel, and of making available a securing element suitable therefore.

For this purpose, a securing element can be latched over the terminal strip from the rear of the front panel, the securing element resting between the latching element and the front panel, and the continuous contour of the securing element forming a stop face on the rear of the front panel, the securing element being at least partially resilient, with the result that the securing element is resilient in the region of the latching element. This means that the latching element presses the securing element against the front panel.

However, the terminal strip thus no longer has any play in the front panel, since it is fixed on the front and rear of the front panel by means of a stop edge or stop face. The continuous contour imparts sufficient strength to the securing element. The latching-on over the rear of the terminal strip means that only a small amount of installation space is required, in contrast to conceivable solutions where the securing element is pushed on laterally between the terminal strip and the front panel. The securing element is now at least partially resilient so that it slides over the latching element and does not shear it off.

In one preferred embodiment, the securing element is integral and is made of metal or plastic, an appropriate design providing the resilience. In addition, embodiments in which the securing element is made from two materials, for example a resilient plastic and a rigid metal or plastic, are also possible in which case the resilient material is used at the desired points of the contour, and, otherwise, owing to the stiffness, the rigid material is used.

In a further preferred embodiment, in particular in the refinement using metal, the contour of the securing element has at least one meandering region. In this case, the desired spring action can be set by the number and/or the thickness of the individual webs of the meander. The advantage of such a refinement is the fact that the contour may be designed to be relatively wide, and the securing element may be designed to be relatively thick, which brings about the appropriate robustness and strength, but is sufficiently resilient. In this case, it should be pointed out that the thickness of the securing element is prescribed by the distance between the latching element and the front panel.

The level of resilience required and the points at which the securing element needs to be resilient depend on the design of the latching element(s) and its/their arrangement along the terminal strip.

In a further preferred embodiment, the securing element has at least two meandering regions which are arranged in a longitudinal region of the contour, these preferably being arranged symmetrically and, further preferably, in the region of the transitions to the transverse regions.

It is further preferred for two meandering regions to be arranged in each of the two longitudinal regions.

As an alternative or in addition to this, the meandering regions may also be arranged in the transverse region of the contour. The advantage of the meandering regions in the longitudinal region, however, is generally the fact that the longitudinal region is considerably longer than the transverse region, with the result that sufficiently long meandering regions can be provided without any loss of robustness.

In a further preferred embodiment, the latching element is or the latching elements are in the form of a wedge or wedges.

In a further preferred embodiment, the terminal strip is formed with fork contacts on the side which is accessible from the rear of the front panel.

In a further preferred embodiment, the terminal strip is formed with insulation-piercing contacts on the side which is accessible from the front of the front panel.

The invention is explained in more detail below with reference to a preferred exemplary embodiment. In the figures.

Figure 1:
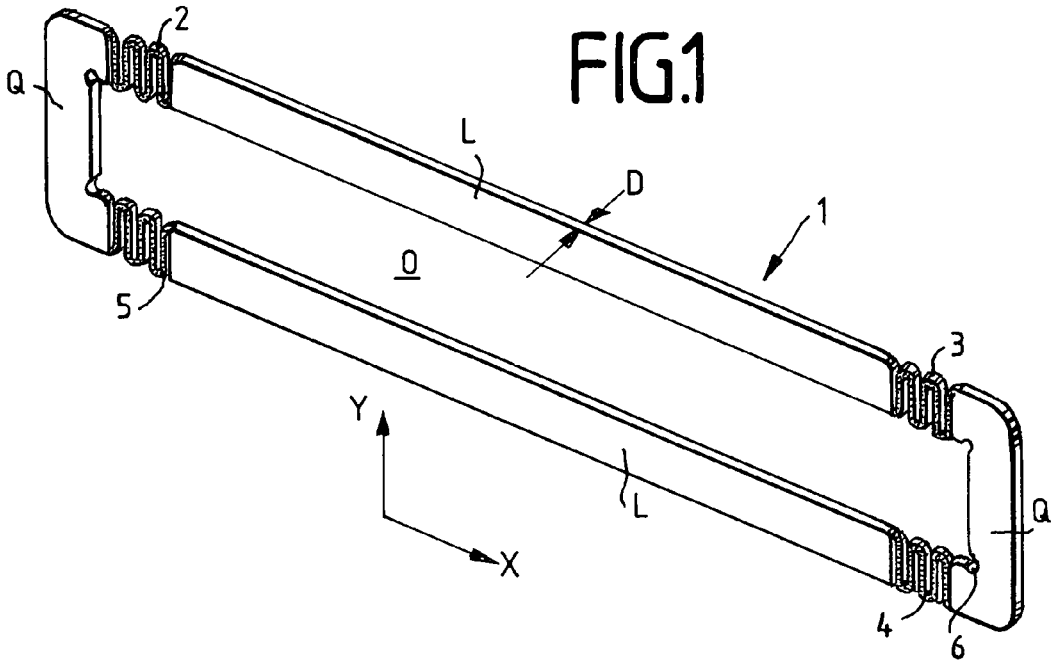
FIG. 1 shows a perspective illustration of a securing element

The securing element 1 comprises a rectangular frame having two longitudinal regions L and two transverse regions Q. Incorporated in each of the longitudinal regions L are two meandering regions 2-5. The securing element 1 in this case has a continuous contour and is produced integrally from metal. Furthermore, the securing element 1 has circular notches 6 at the corner points between the longitudinal region L and the transverse region Q. The securing element 1 has the thickness D, the thickness D being matched to the distance between a latching element 16 and a front panel 12, which will be explained in more detail below. In the interior, the securing element 1 has an opening O which is matched to the dimensions of a terminal strip to be fixed. Owing to the meandering regions 2-5, the securing element 1 is resilient primarily in the direction of the longitudinal region L (X direction). However, this arrangement also allows for a certain resilient movement in the direction of the transverse regions Q (Y direction). The degree of this deflection in the direction of the transverse regions Q (Y direction) is in this case dependent on the length of the meandering regions 2-5, as well as the regions of the individual webs of the meander. The opening O is in this case selected such that the latching elements 16, stop against the longitudinal regions L without being extended in a resilient manner.

Figure 3:
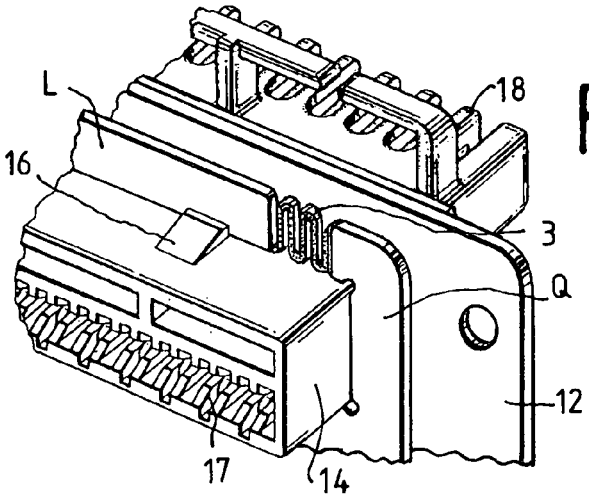
FIG. 3 shows a detailed illustration of the securing means and FIG. 4 shows a sectional illustration through the connection module.
Figure 4:
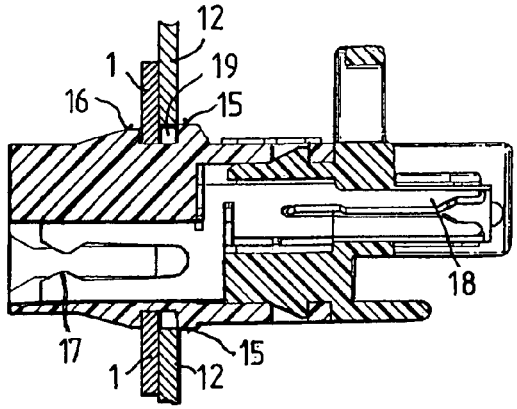
Figure 2:
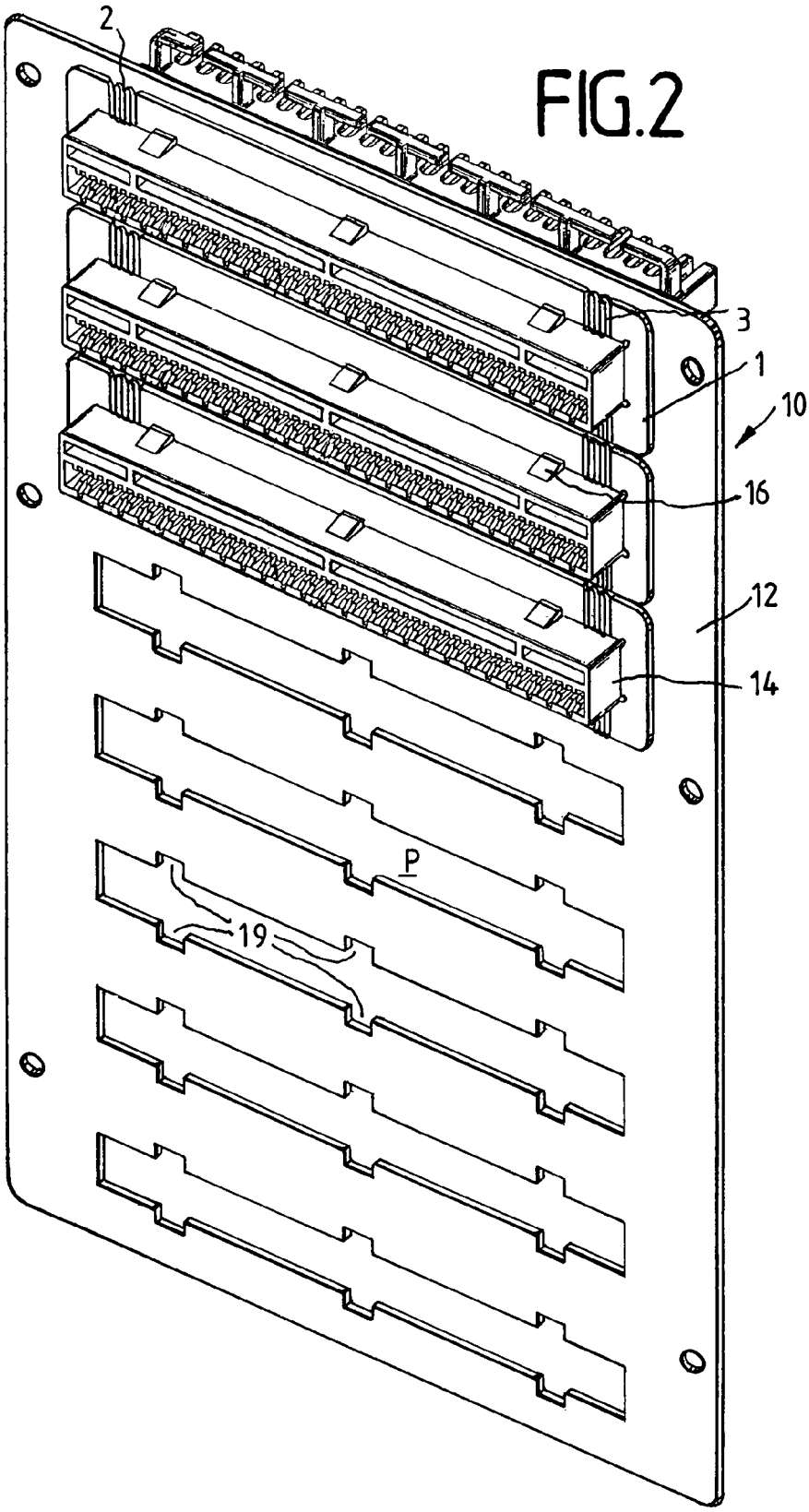
FIG. 2 shows a perspective rear view of a front panel with terminal strips fitted on it

The interaction of the securing element 1 with the other elements of an electrical connection module 10 is explained in more detail with reference to FIGS. 2 to 4. The connection module 10 comprises a front panel 12 and a number of terminal strips 14. The front panel 12 in this case has openings P, through which the terminal strips 14 can be passed from the front of the front panel 12 until they stop, with a stop edge 15, at the front of the front panel 12. The stop edge 15 in this case preferably runs around the complete circumference of the opening P in the front panel 12. In addition, the opening P in the front panel 12 has cutouts 19 in the region of the latching elements 16 of the terminal strips 14, with the result that the latching elements 16 can be passed through the rigid front panel 12. As can be seen in FIG. 2, the terminal strips 14 have three such latching elements 16, on the upper side three such latching elements 16 preferably likewise being arranged on the underside (not shown). Correspondingly, the opening P in the front panel 12 has six cutouts 19. Once the terminal strip 14 has been passed through from the front of the front panel 12, the securing element 1 is latched with the latching elements 16 from the rear via the terminal strip 14, the resilient extension in the direction of the longitudinal direction of the transverse regions Q (Y direction upwards and downwards) making it possible for the securing element 1 to be pushed over the latching elements 16. Behind the latching elements 16, the securing element 1 then springs back and latches in between the latching elements 16 and the rear of the front panel 12. In this case, the longitudinal regions L and the transverse regions Q act as a stop face on the rear of the front panel 12 around the opening P for the terminal strips 14. The respective terminal strip 14 is thus fixed at the front and rear by means of stop edges or stop faces. If a printed circuit board (not shown) is now pushed onto the fork contacts 17 of the terminal strip 14 from the rear of the front panel 12, the terminal strip 14 can thus not be pushed out. The terminal strip 14 is likewise fixed from the front of the front panel 12 when the insulation-piercing contacts 18 are connected.

LIST OF REFERENCE NUMERALS

1—Securing element
L—Longitudinal region of the securing element
Q—Transverse region of the securing element
D—Thickness of the securing element
O—Opening in the securing element
2—Meandering region
3—Meandering region
4—Meandering region
5—Meandering region
6—Circular notches
10—Electrical connection module
12—Front panel
P—Opening in the front panel
14—Terminal strips
15—Stop edge
16—Latching element
17—Fork contact
18—Insulation-piercing contacts
19—Cutouts

The invention claimed is:

1. An electrical connection module, comprising:

at least one terminal connector for electrically connecting wires or cables, the terminal connector including at least one latching element arranged opposite from at least one stop edge, a rigid panel defining a first side and an opposite second side, the panel defining at least one opening through which the terminal connector is configured to be partially passed until the stop edge of the terminal connector abuts against the first side of the panel, the panel defining at least one cutout through which the latching element of the terminal connector is configured to be passed when the terminal connector is partially passed through the opening, and a securing element latched over the terminal connector from the second side of the panel, the securing element being made of metal or plastic and including a frame defining a first resilient section, a second resilient section, and a rigid section extending between the resilient sections, the resilient sections enabling the rigid section to ride over the latching element of the terminal connector, at least one of the resilient sections being a curved web, the rigid section forming a stop face against which the latching element of the terminal connector is configured to abut to inhibit the latching element from passing back through the cutout defined in the panel.

2. The electrical connection module as claimed in claim 1, wherein the securing element is formed in one-piece.

3. The electrical connection module as claimed in claim 1, wherein the frame including two first sides extending in a longitudinal direction and two second sides extending in a transverse direction.

4. The electrical connection module as claimed in claim 3, wherein the rigid section and the first and second resilient sections are arranged on one of the first sides of the frame.

5. The electrical connection module as claimed in claim 4, wherein each of the first sides defines a rigid section extending between two resilient sections.

6. The electrical connection module as claimed in claim 3, wherein the rigid section and the resilient sections are arranged along one of the second sides of the frame.

7. The electrical connection module as claimed in claim 6, wherein each of the second sides defines a rigid section extending between two resilient sections.

8. The electrical connection module as claimed in claim 1, wherein the at least one latching element is in the form of a wedge.

9. The electrical connection module as claimed in claim 1, wherein the terminal connector is formed with fork contacts which are accessible from the second side of the panel.

10. The electrical connection module as claimed in claim 1, wherein the terminal connector is formed with insulation-piercing contacts which are accessible from the first side of the panel.

11. A securing element for fixing a terminal connector to a panel, comprising:

a pair of sides extending in a longitudinal direction from first ends to second ends;

a pair of ends extending in a transverse direction between the pair of sides to define an opening, the ends being coplanar with the sides;

a first resilient, curved web arranged at the first end of a first of the sides;

a second resilient, curved web arranged at the second end of the first side, the first and second resilient, curved webs cooperating to enable the first side to move in the transverse direction;

a third resilient, curved web arranged at the first end of a second of the sides;

a fourth resilient, curved web arranged at the second end of the second side, the third and fourth resilient, curved webs cooperating to enable the second side to move in the transverse direction;

wherein the sides, ends, and resilient, curved webs form an integral frame.

12. The securing element as claimed in claim 11, wherein the integral frame defines notches at corner points of the opening defined by the sides and ends.

13. The securing element as claimed in claim 11, wherein each of the sides and ends defines a generally flat front surface and a generally flat rear surface.

14. The securing element as claimed in claim 11, wherein the curved webs enable the ends to move in the longitudinal direction.

* * * * *